United States Patent [19]

Honegger

[11] Patent Number: 4,682,741

[45] Date of Patent: Jul. 28, 1987

[54] APPARATUS FOR UNWINDING FLEXIBLE FLAT PRODUCTS, ESPECIALLY PRINTED PRODUCTS, ARRIVING CONTINUOUSLY, ESPECIALLY IN IMBRICATED FORMATION

[75] Inventor: Werner Honegger, Tann-Rüti, Switzerland

[73] Assignee: Ferag AG, Hinwil, Switzerland

[21] Appl. No.: 852,721

[22] Filed: Apr. 14, 1986

Related U.S. Application Data

[62] Division of Ser. No. 728,219, Apr. 29, 1985, Pat. No. 4,601,436.

[30] Foreign Application Priority Data

May 9, 1984 [CH] Switzerland ..... 2267/84

[51] Int. Cl.[4] ..... B65H 16/04; B65H 75/02

[52] U.S. Cl. ..... 242/55; 242/68.5; 242/75.4; 242/59; 242/68.3

[58] Field of Search ..... 242/55, 59, 75.4, 67.3 R, 242/68, 68.1, 68.2, 68.3, 68.5, 68.6, 117; 53/117-119, 430

[56] References Cited

U.S. PATENT DOCUMENTS

| | | | |
|---|---|---|---|
| 1,935,367 | 11/1933 | Lippitt et al. | 242/68.6 |
| 2,223,682 | 12/1940 | Gammeter | 242/68.6 |
| 2,565,335 | 8/1951 | White | 242/68 X |
| 2,628,814 | 2/1953 | Spalding | 242/117 X |
| 2,846,159 | 8/1958 | Reynolds | 242/67.1 R |
| 3,066,388 | 12/1962 | Cooper | 242/59 X |
| 3,465,978 | 9/1969 | Bernau et al. | 242/4 B |
| 3,893,636 | 7/1975 | Wise et al. | 242/68.1 |
| 4,438,618 | 3/1984 | Honegger | 242/59 X |
| 4,532,750 | 8/1985 | Meier | 242/59 X |

FOREIGN PATENT DOCUMENTS

| | | |
|---|---|---|
| 280681 | 12/1962 | Australia . |
| 49435 | 1/1969 | Australia . |

*Primary Examiner*—John M. Jillions

*Attorney, Agent, or Firm*—Werner W. Kleeman

[57] ABSTRACT

The apparatus for unwinding flexible, substantially flat products, especially printed products, wound together with a winding strap into a wound package from such a wound package, comprises a substantially hollow and substantially cylindrical winding core and a support arrangement for rotatably and releasably supporting the winding core constructed as an annular friction wheel. This annular friction wheel is structured for deposition upon and lifting from the support arrangement. The annular friction wheel contains at its inner side a traction surface coaxial with the longitudinal axis of the annular friction wheel. This annular friction wheel also possesses side flanges extending inwardly towards its longitudinal axis for laterally delimiting the traction surface. The support arrangement comprises freely rotatable support wheels and the traction surface bears upon these freely rotatable support wheels. There is also provided a braking member structured for operatively engaging the winding core. The winding core is simple in construction and economical in manufacture.

16 Claims, 10 Drawing Figures

Fig.7
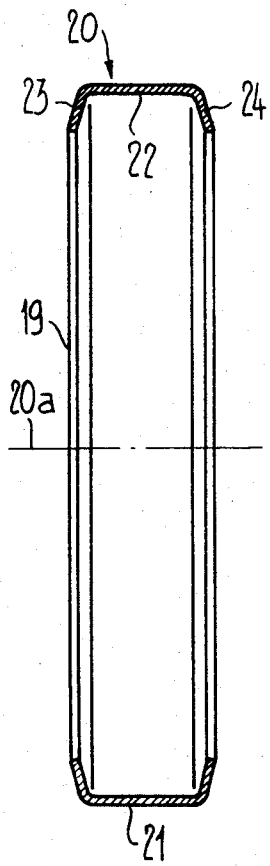
Fig.8
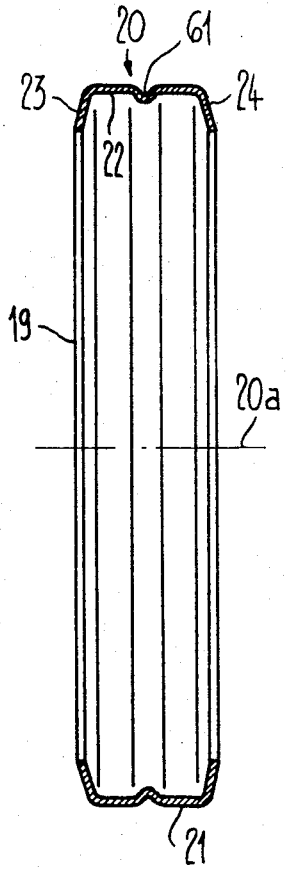
Fig.9
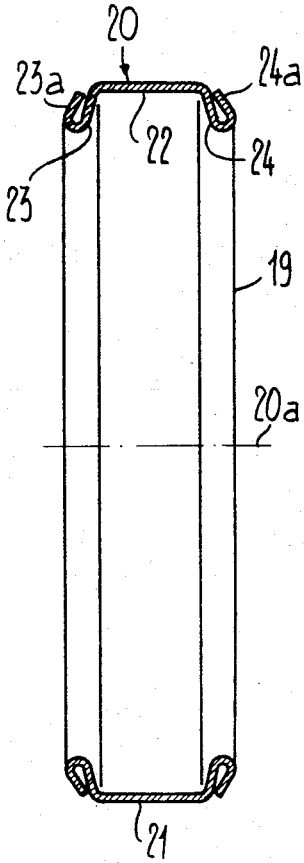
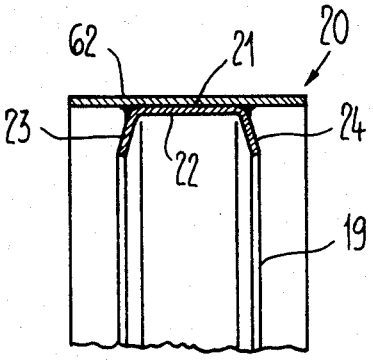
Fig. 10

APPARATUS FOR UNWINDING FLEXIBLE FLAT PRODUCTS, ESPECIALLY PRINTED PRODUCTS, ARRIVING CONTINUOUSLY, ESPECIALLY IN IMBRICATED FORMATION

CROSS-REFERENCE TO RELATED APPLICATIONS:

This application is related to the commonly assigned, copending U.S. patent application Ser. No. 06/649,371, filed Sept. 19, 1983, now U.S. Pat. No. 4,593,865, granted June 10, 1986, and entitled "Winding Mandrel for a Coil or Wound Package Formed of Flexible, Substantially Flat Products, Especially Printed Products".

Furthermore, this application is a divisional application of my commonly assigned, copending U.S. patent application Ser. No. 06/728,219, filed on Apr. 29, 1985, now Pat. No. 4,601,436, granted Jul. 22, 1986, and entitled "Apparatus for Winding and Unwinding Flexible Flat Products, Especially Printed Products, Arriving Continuously, Especially in Imbricated Formation".

BACKGROUND OF THE INVENTION:

The present invention broadly relates to winding machinery for forming storage coils and, more specifically, pertains to a new and improved construction of an apparatus for winding flexible, substantially two-dimensional or flat products, especially printed products, arriving continuously, especially in imbricated formation, together with a winding strap into a product coil or wound package and for unwinding the products from such a coil or wound package. The present invention also relates to a winding core for employment with such an apparatus.

Generally speaking, the apparatus of the present invention comprises a substantially hollow and substantially cylindrical winding core drivable in a winding procedure and a support arrangement for rotatably and releasably supporting the winding core.

The winding core of the present invention is substantially hollow and substantially cylindrical and is intended for employment in the apparatus of the invention.

It is known to the art to wind printed products discharged by a rotogravure machine in imbricated formation conjointly with a winding strap or a pair of winding straps upon a winding core (cf. Swiss Patent No. 559,691, granted Jan. 31, 1975; German Pat. No. 3,123,888 and the corresponding U.S. Pat. No. 4,438,618, granted Mar. 27, 1984; as well as the German Patent Publication No. 3,236,866 and the corresponding British Patent Publication No. 2,107,681, both corresponding to the U.S. patent application Ser. No. 06/432,557, filed Oct. 4, 1982 now U.S. Pat. No. 4,587,790, granted May 13, 1986). The completed printed product coils or wound packages are then stored in an intermediate storage station and removed from the intermediate storage station at a desired later time and conducted to a processing station. The printed products are removed from the storage coil or wound package at this processing station by an unwinding procedure.

The apparatus known from the aforementioned Swiss Patent No. 559,691 comprises a shaft which is driven in the winding up procedure and upon which the empty winding core, respectively a hollow cylindrical winding core carrying the coil or wound package, must be mounted. The inside diameter of the winding core corresponds to the outside diameter of the shaft. The mounting of the winding core on the shaft and the retraction of the winding core from the shaft is difficult and also requires a certain amount of care. Furthermore, the winding core must be precisely machined for a good seat on the shaft.

The known winding core is provided with side cheeks or side plates for facilitating transport which are configured as rolling surfaces or flanges. The economy of space in storing the empty winding cores, however, leaves something to be desired due to these side plates. Furthermore, the fabrication of such winding cores is relatively complicated.

SUMMARY OF THE INVENTION

Therefore, with the foregoing in mind, it is a primary object of the present invention to provide a new and improved construction of an apparatus for unwinding flexible, substantially two-dimensional or flat products, especially printed products, wound together with at least one winding strap into a coil or wound package, which does not exhibit the aforementioned drawbacks and shortcomings of the prior art constructions.

Another and more specific object of the present invention aims at providing a new and improved construction of an apparatus of the previously mentioned type which is simple, compact and reliable in design and in which the coupling and decoupling of the winding core can be performed at modest temporal and constructive expense and which permits simple manipulation as well as space-saving storage both of the empty and of the full winding core.

Yet a further significant object of the present invention aims at providing a new and improved construction of an apparatus of the character described which is relatively simple in construction and design, extremely economical to manufacture, highly reliable in operation, not readily subject to breakdown and malfunction and requires a minimum of maintenance and servicing.

Now in order to implement these and still further objects of the invention, which will become more readily apparent as the description proceeds, the apparatus of the present invention is manifested by the features that the winding core is constructed as an annular friction wheel. The annular friction wheel is structured for deposition upon and lifting from a support arrangement for rotatably and releasably supporting the winding core. The annular friction wheel has an inner side and a longitudinal axis and the annular friction wheel comprises at such inner side thereof a traction surface coaxial with the longitudinal axis. Moreover, the annular friction wheel comprises side flanges extending inwardly toward its longitudinal axis for laterally delimiting the traction surface. The support arrangement comprises freely rotatable support wheels and the traction surface bears upon these freely rotatable support wheels. A braking member is provided and is structured for operatively engaging the winding core.

The winding core of the present invention is manifested by the features that it is constructed as an annular friction wheel of a friction wheel drive arrangement, the annular friction wheel having an inner side and a longitudinal axis, the annular friction wheel comprising a traction surface coaxial with the longitudinal axis upon the inner side, and the annular friction wheel containing side flanges extending inwardly toward the longitudinal axis for laterally delimiting the traction surface.

The construction of the winding core as an annular friction wheel of a friction wheel drive arrangement permits a rapid deposition of the winding core upon the support wheels and a rapid lifting of the winding core from the support wheels. An automatic centering of the winding core is effected by the side flanges provided on the winding core both when depositing the winding core upon the support wheels and during the winding procedure. The winding core can be simply configured and can comprise a lesser width than the coil or wound package, which leads to lower material and fabrication costs. Furthermore, a minimum of space is required for storing both the empty winding cores and the winding cores carrying a product coil or wound package.

BRIEF DESCRIPTION OF THE DRAWINGS:

The invention will be better understood and objects other than those set forth above, will become apparent when consideration is given to the following detailed description thereof. Such description makes reference to the annexed drawings wherein throughout the various figures of the drawings there have been generally used the same reference characters to denote the same or analogous components and wherein:

FIGS. 7 through 10 schematically show various embodiments of the winding core in longitudinal section.

DETAILED DESCRIPTION OF THE PREFERRED EMBODIMENTS

Figure 1:
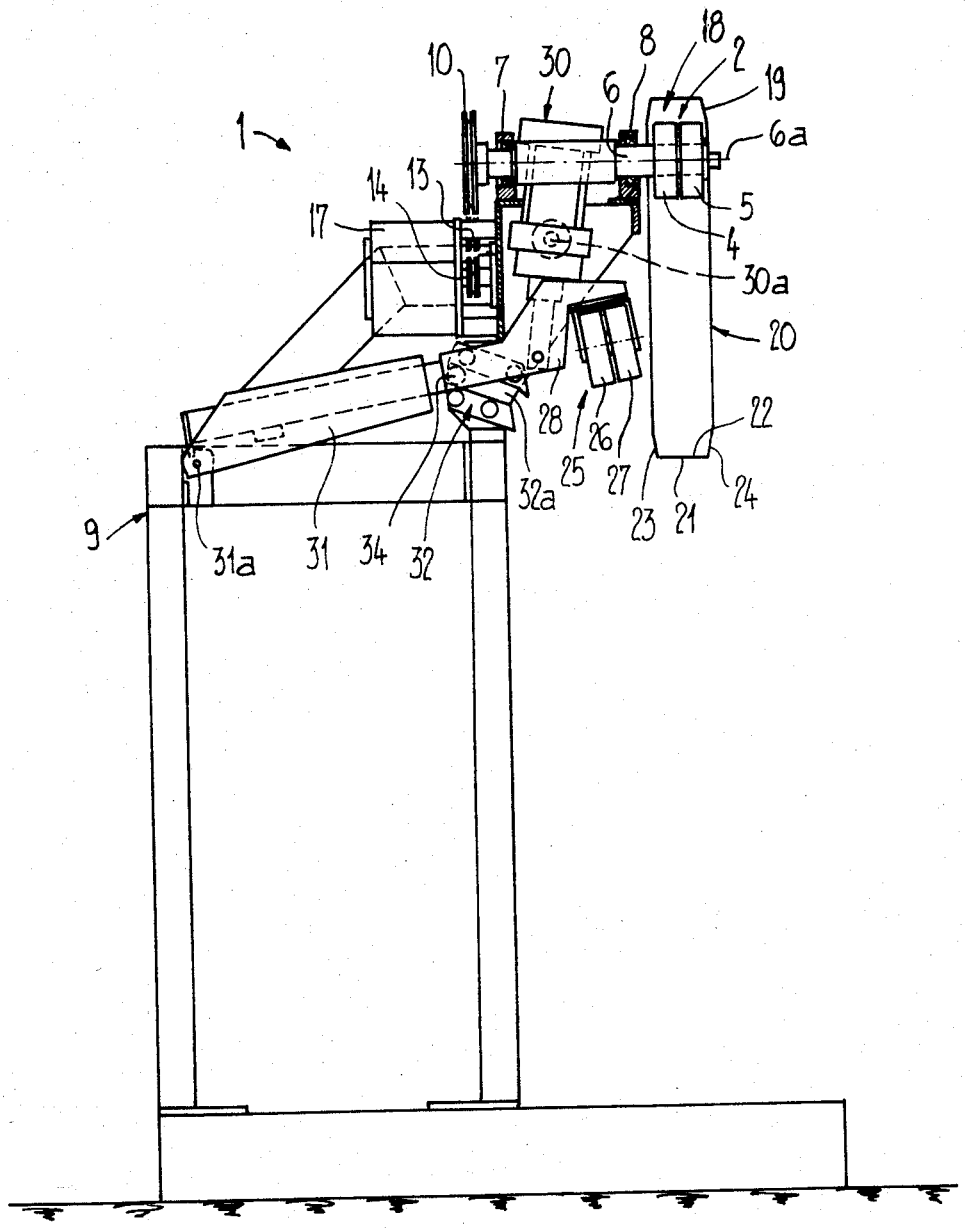
FIG. 1 schematically shows an apparatus for winding printed products in side elevation before beginning the winding procedure.

Describing now the drawings, it is to be understood that to simplify the showing thereof only enough of the structure of the apparatus for winding flexible, substantially two dimensional or flat products, especially printed products, arriving continuously, especially in imbricated formation, together with at least one winding strap into a product coil or wound package and unwinding the same from such a product coil or wound package has been illustrated therein as is needed to enable one skilled in the art to readily understand the underlying principles and concepts of this invention. Turning now specifically to FIG. 1 of the drawings, the apparatus illustrated therein by way of example and not limitation will be seen to comprise a winding station 1 for winding printed products arriving in imbricated formation up into a product coil or wound package.

Figure 3:
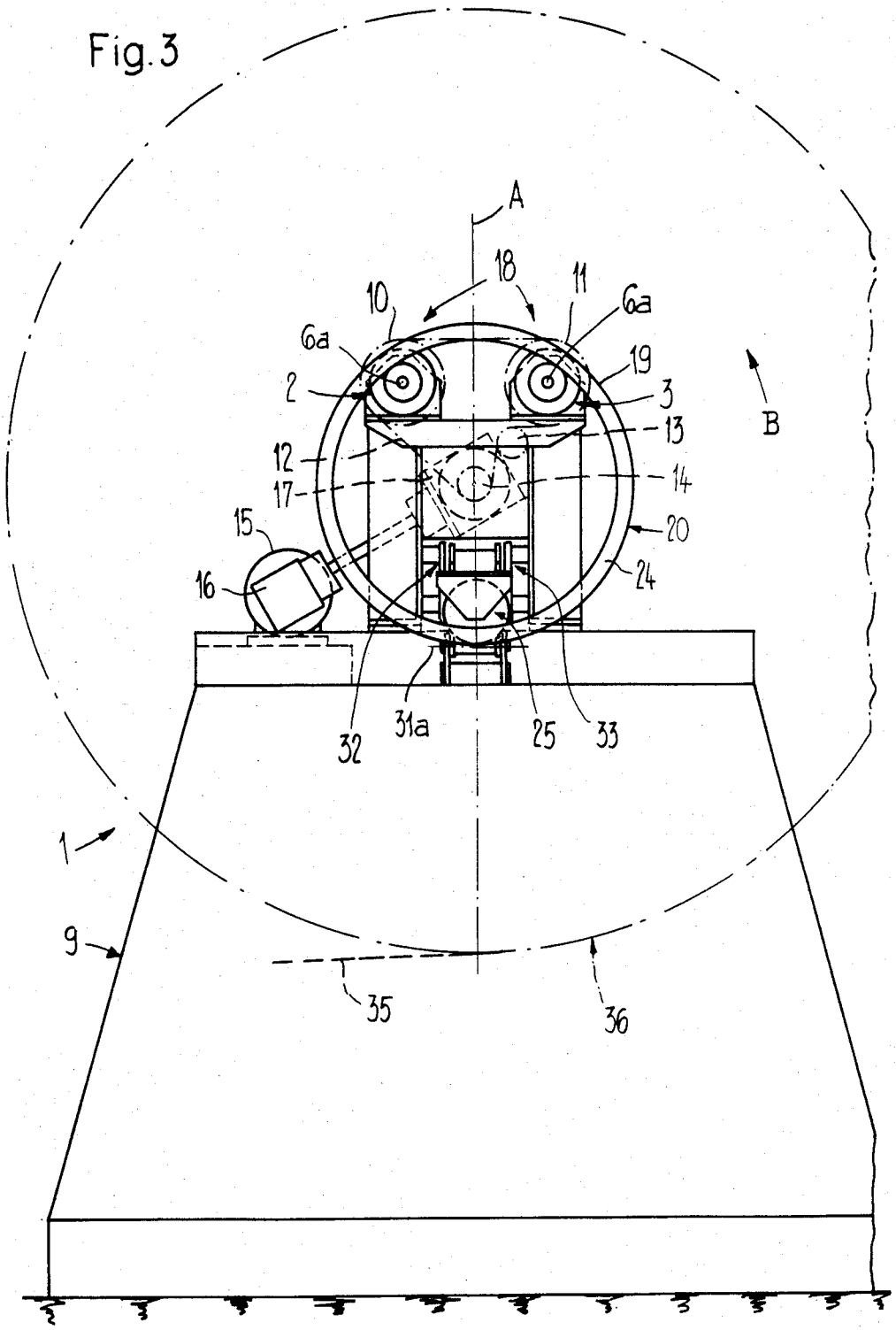
FIG. 3 schematically shows the apparatus according to FIG. 2 in front elevation as viewed in the direction of the arrow III in FIG. 2.

This winding station comprises two freely rotatable support wheels 2 and 3 which are situated opposite to one another in relation to a vertical plane designated with the reference character A (cf. FIG. 3). These support wheels 2 and 3 are constructed as friction wheels and, in the exemplary embodiment illustrated, each comprise two mutually coupled rollers 4 and 5. It will be understood that the support wheels 2 and 3 can each also comprise only a single roller. The support wheels 2 and 3, respectively the rollers 4 and 5, are keyed upon a shaft 6 whose longitudinal axis is designated with the reference character 6*a*. This shaft 6 is rotatably journalled in two journals or bearings 7 and 8 which are fastened to a frame generally designated with the reference numeral 9.

Chain wheels or sprockets sprockets 10 and 11 are seated upon the ends of the shafts 6 opposite the support wheels 2 and 3, respectively. A chain 12 runs over the two chain sprockets 10 and 11, as indicated in FIG. 3. This chain 12 is further conducted over a tensioning wheel or sprocket 13 as well as over a drive wheel or sprocket 14. The latter is driven by a drive motor 15 through a winding transmission 16 and an angle gear drive 17 (cf. FIG. 3). The winding transmission 16 is of conventional construction and can be, for instance, a winding transmission of the type purveyed by P.I.V. Antrieb Werner Reimers KG of West Germany.

The two support wheels 2 and 3 form part of a friction wheel drive arrangement 18 which further comprises an annular friction wheel 19. The annular friction wheel 19 simultaneously constitutes a winding core 20 upon which the printed products are wound up. This winding core 20 comprises, as can be especially well seen in FIG. 7, an annular rim 21 whose exposed inner surface is constructed as a running or traction surface 22. This traction surface 22 is laterally delimited by side flanges 23 and 24 which are oriented inwardly, i.e. radially toward the longitudinal axis 20*a* of the winding core 20, from the annular rim 21. As shown in FIG. 1, these side flanges 23 and 24 do not necessarily form a right angle with the annular rim 21, but may be oriented somewhat off to the side.

The winding core 20 comes into contact with the support wheels 2 and 3 with its traction surface 22 and is set into rotation by these support wheels 2 and 3. The side flanges 23 and 24 running laterally of the support wheels 2 and 3 prevent a lateral drift of the winding core 20 running over the support wheels 2 and 3.

A guide wheel 25 is arranged beneath and approximately in the center between the two support wheels 2 and 3. The guide wheel 25, in the exemplary embodiment illustrated, also comprises two mutually coupled rollers 26 and 27. This guide wheel 25 is fastened on the end of an arm 28 upon which the piston rod 29 of a pneumatic (or possibly hydraulic) piston-and-cylinder unit 30 engages. This piston-and-cylinder unit 30 is pivotably journalled in the frame 9 about an axis designated with the reference character 30*a*. The arm 28 is also longitudinally translatably guided in a guide element 31 (cf. FIGS. 1 and 2) which is pivotably mounted on the frame 9 about an axis 31*a*. Guide means 32 and 33 are arranged on both sides of the arm 28. Each of these guide means 32 and 33 comprises a downwardly inclined guideway 32*a* (cf. FIGS. 1 and 2) in which a roller 34 fastened to the arm 28 is guided. Only one of the two mutually opposing guide rollers 34 is represented in FIGS. 1 and 2.

When the piston rod 29 is retracted, the arm 28 together with the guide wheel 25 is situated in its raised rearward end position, which is illustrated in FIG. 1. When the piston rod 29 is extended, the arm 28 together with the guide element 31 is pivoted about the axis 31*a* and simultaneously translated in its longitudinal direction in the guideways 32*a* due to the guidance of the rollers 34. At the end of this translatory and pivotal motion the arm 28 and the guide wheel 25 assume a lower forward end position in which the guide wheel 25 engages within the winding core 20 and is pressed against the traction surface 22 of the winding core 20, as shown in FIG. 2. The winding core 20 is pressed against the support wheels 2 and 3 constructed as friction wheels with its traction surface 22 by the pressure exerted by the piston-and-cylinder unit 30 through the guide wheel 25 upon the winding core 20 in order to ensure an impeccable frictional engagement between the support wheels 2 and 3 and the winding core 20. The guide wheel 25 engaging between the side flanges 23 and 24 serves to maintain the winding core 20 in a substantially vertical position.

The deposition of an empty winding core 20 upon the support wheels 2 and 3 is undertaken with the guide wheel 25 in its upper rear end position (cf. FIG. 1). Subsequently, the guide wheel 25 is moved into its lower forward end position in the manner previously described (cf. FIG. 2). By driving the support wheels 2 and 3 in the direction of the arrow B (cf. FIG. 3), the winding core 20 is now set into rotation. Due to the inner contact of the support wheels 2 and 3 with the winding core 20, the winding core 20 also rotates in the direction of the arrow B. The winding of the printed products conveyed in underfeed to the winding core 20 together with the winding strap indicated in dotted lines in FIG. 3 and designated with the reference numeral 35 is essentially performed in the manner described in the previously mentioned German Pat. No. 3,123,888 and the corresponding U.S. Pat. No. 4,438,618, also previously mentioned.

Figure 2:
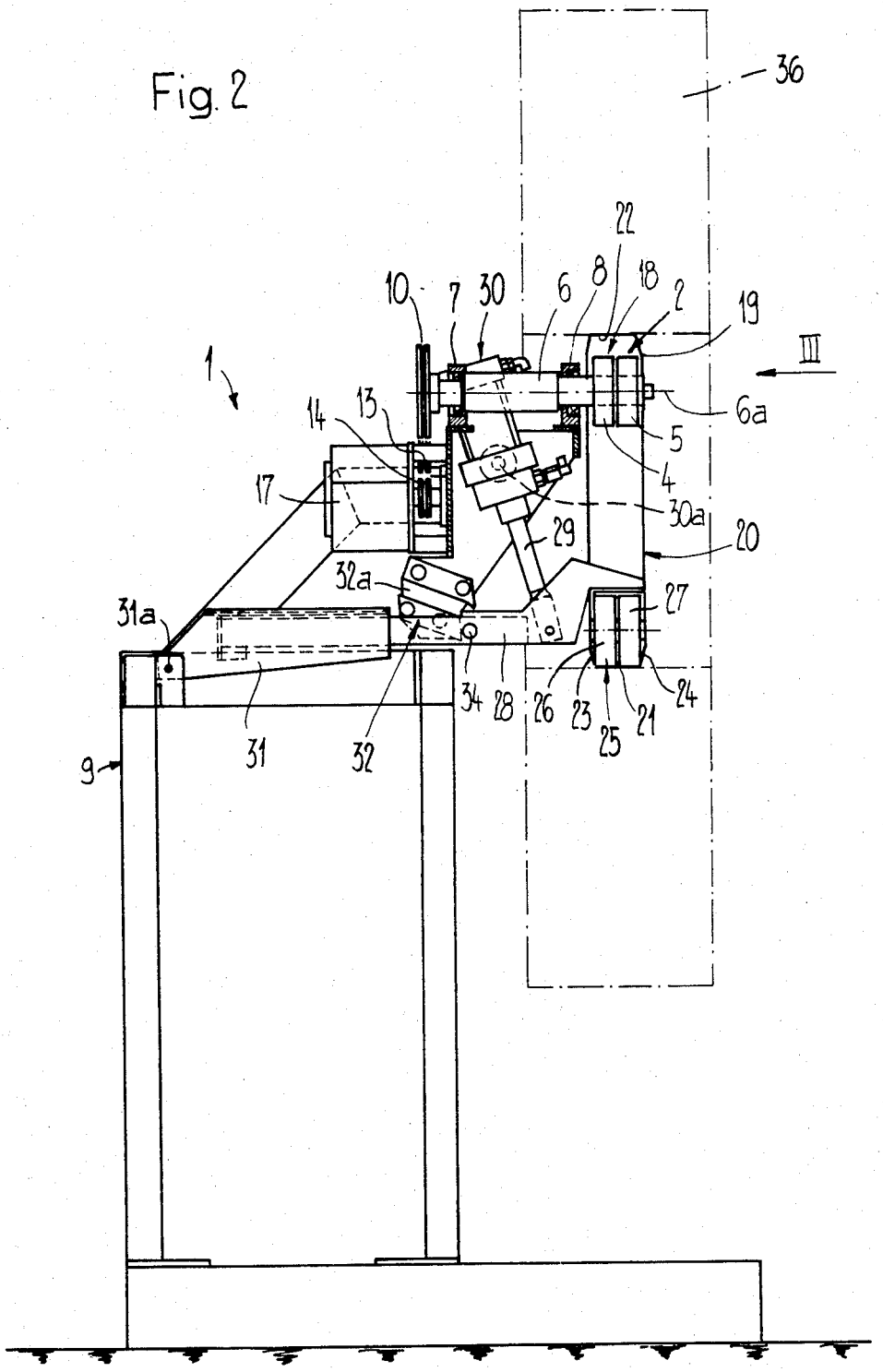
FIG. 2 schematically shows the winding apparatus prepared for the winding procedure in a view corresponding to that of FIG. 1.

After termination of the winding procedure, the guide wheel 25 is moved back into its end position shown in FIG. 1, whereupon the winding core 20 together with the coil or wound package 36 formed thereupon and indicated in FIGS. 2 and 3 is lifted from the support wheels 2 and 3 and transported away. Now a new empty winding core 20 can be coupled in the manner already described.

Figure 4:
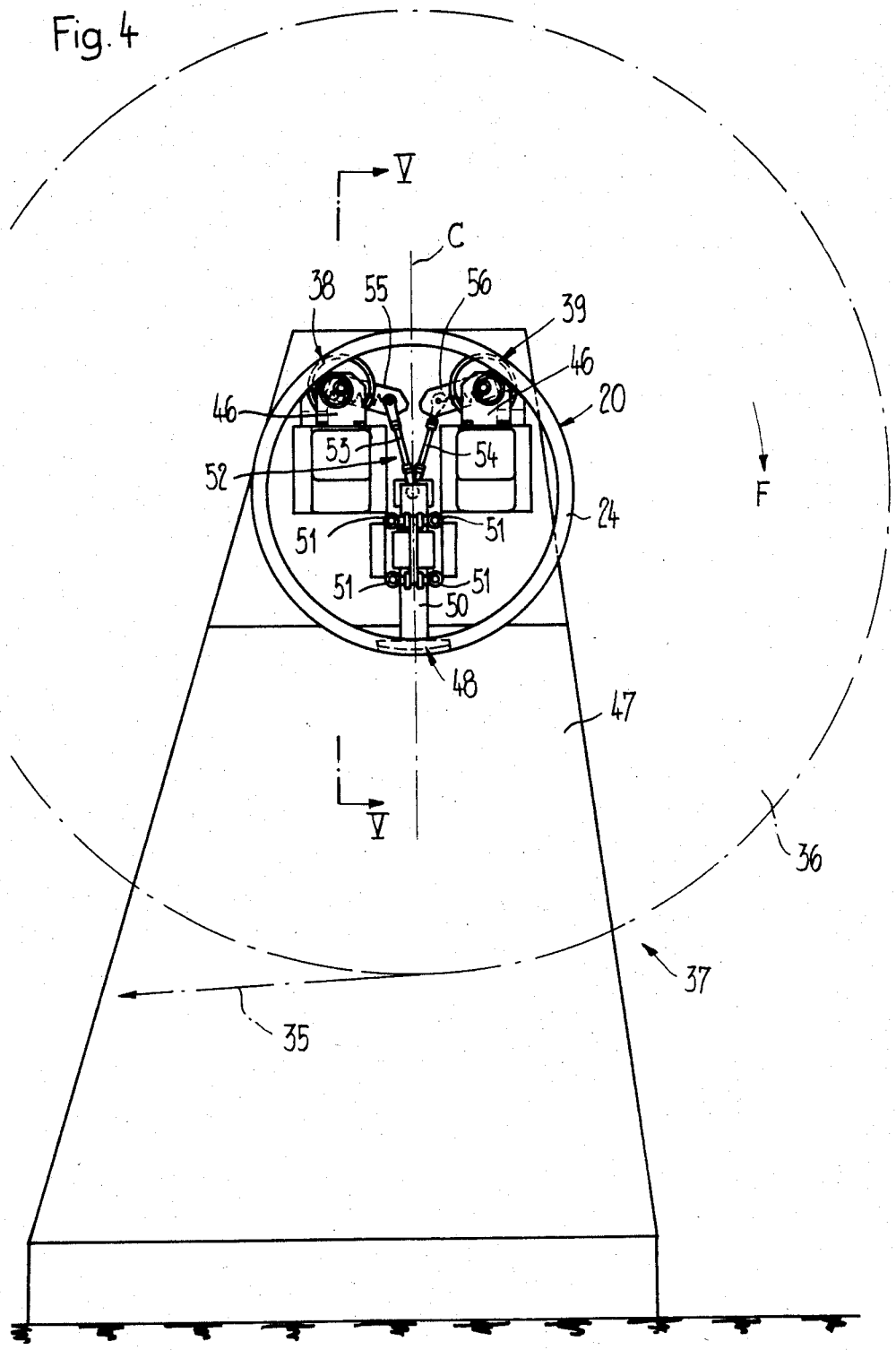
FIG. 4 schematically shows an apparatus for unwinding the printed products from a coil or wound package in front elevation.
Figure 5:
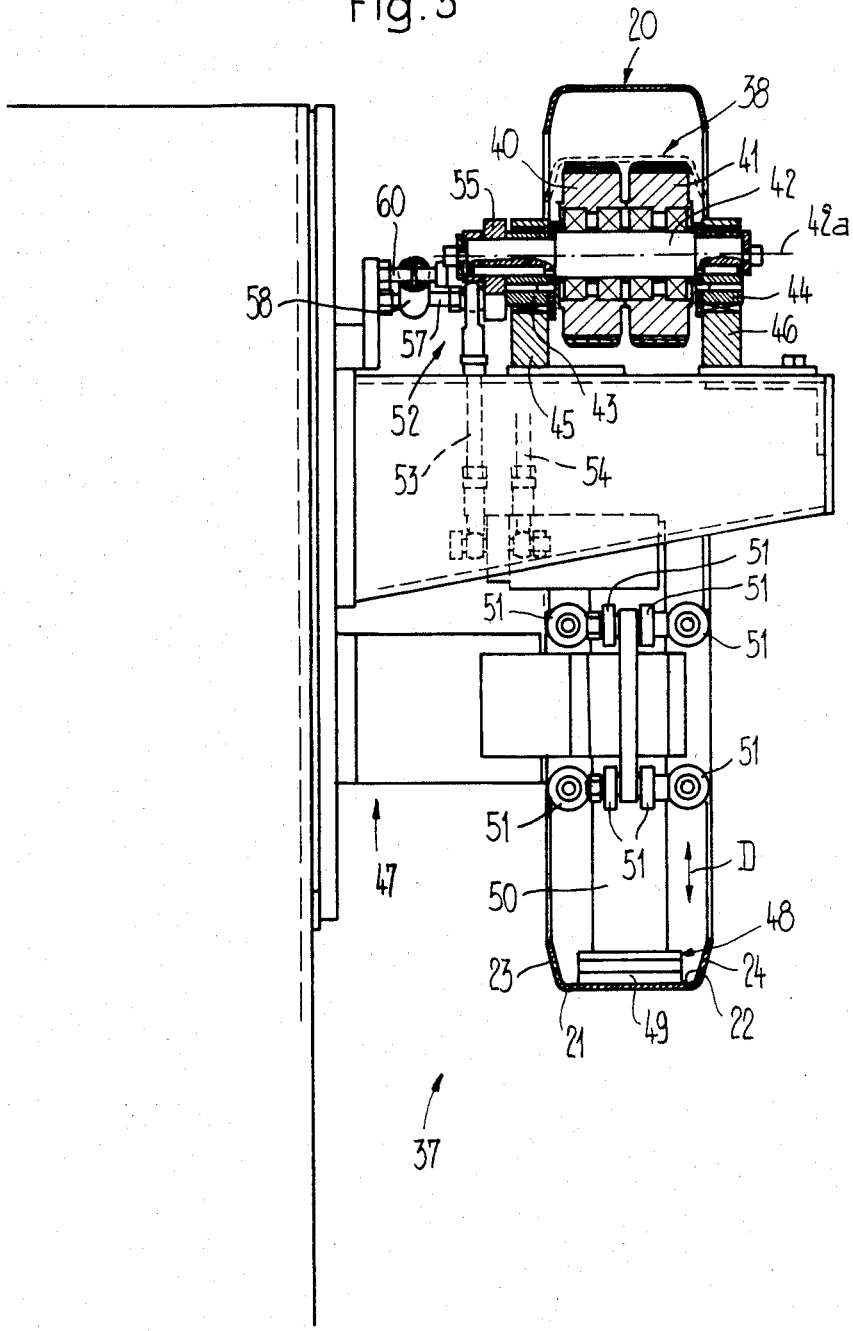
FIG. 5 schematically shows a section taken approximately along the line V—V in FIG. 4.
Figure 6:
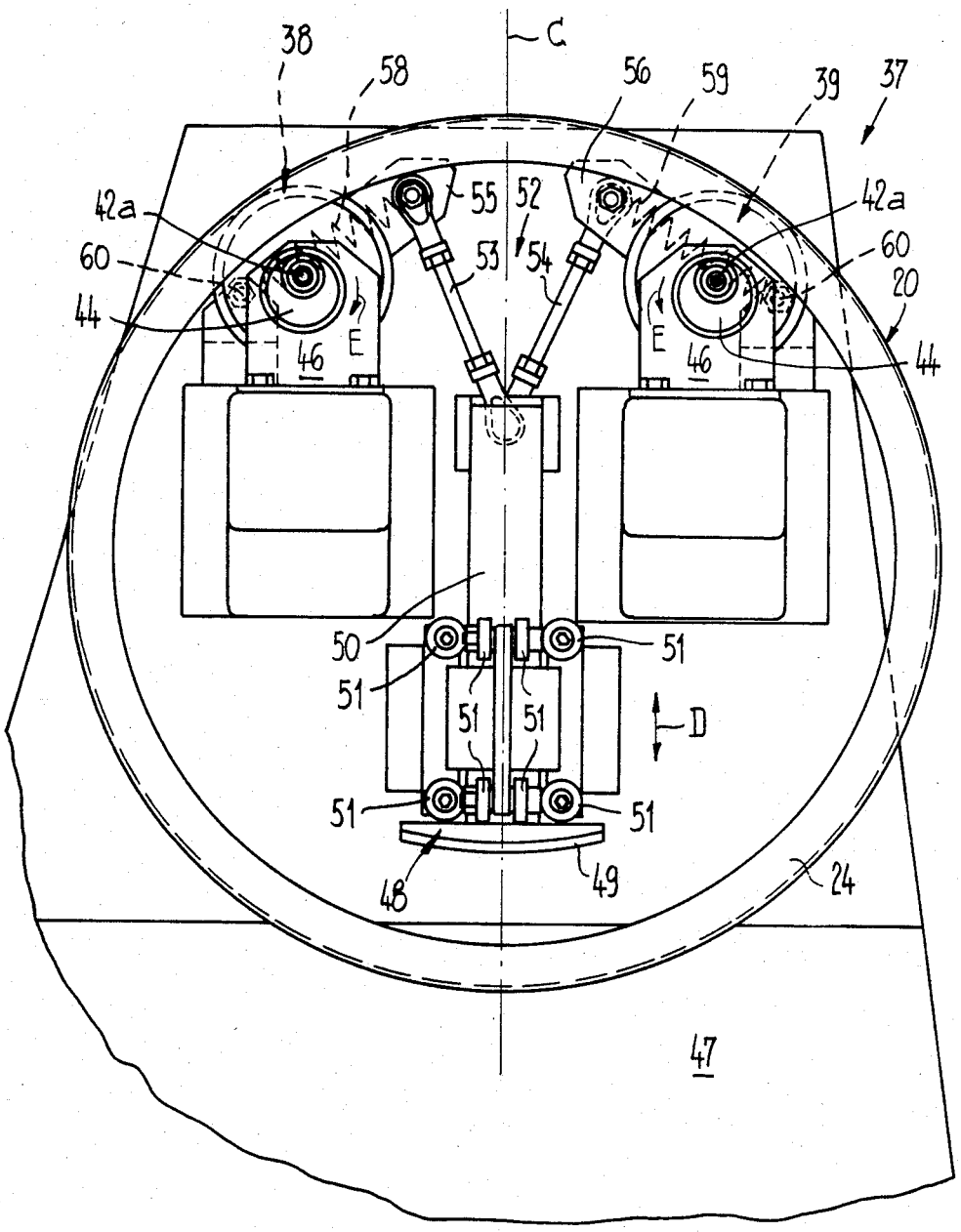
FIG. 6 schematically shows the unwinding apparatus in front elevation on an enlarged scale in relation to FIG. 4 with the braking device released.

An unwinding station 37 is shown in the FIGS. 4 through 6 in which the printed products can be removed from the coil or wound package 36.

This unwinding station 37 comprises two freely rotatable support wheels 38 and 39 which are situated opposite one another in relation to a vertical plane C (cf. FIGS. 4 and 6). Each of these support wheels 38 and 39 is, in the present illustrative embodiment, formed by two mutually coupled rollers 40 and 41 (cf. FIG. 5), which are rotatably journalled upon a shaft 42. Each of the two shafts 42, whose axes are designated with the reference character 42*a*, is held eccentrically in two journal members or bearings 43 and 44 (cf. especially FIG. 5). Each journal member 43 and 44 is rotatably journalled in a journal or bearing plate 46 which is fastened to a frame generally designated with the reference numeral 47.

A brake shoe 48 is arranged beneath and in the center between the two support wheels 38 and 39. The brake shoe 48 comprises a brake pad or lining 49 made of suitable material upon its underside. The brake shoe 48 is fastened to a plunger 50 of rectangular cross section which is vertically reciprocatable in the direction of the arrow D (cf. FIG. 6). Two guide rollers 51 which contact the lateral surfaces of the plunger 50 are provided for guiding the plunger 50.

An actuating mechanism 52 is provided for moving the plunger 50 together with the brake shoe 48. The actuating mechanism 52 comprises two connecting rods 53 and 54 engaging the upper end of the plunger 50. Each of these connecting rods 53 and 54 is hingedly connected to a pivot lever 55, respectively 56, at its upper end. Each pivot lever 55 and 56 is stationarily connected to the journal member 43 of the journalling for the shaft 42 of one of the two support wheels 38 and 39. The extension of a hinge pin which connects the connecting rod 53 or 54 with the associated pivot lever 55, respectively 56 (cf. FIG. 5) forms a pin 57. A tension spring 58, respectively 59, engages the pin 57. The other ends of the tension springs 58 and 59 are fastened to a pin 60 mounted on the frame 47.

The brake shoe 48 is shown in its upper idle position in FIG. 6. The pivot levers 55 and 56 of the actuating mechanism 52 are also situated in their upper pivot position, in which they are held by the tension springs 48 and 59. Since the journal members 43 and 44, as already mentioned, are connected to the pivot levers 55 and 56, these journal members 43 and 44, and therefore also the shafts 42 of the support wheels 38 and 39, assume the upper end position illustrated in FIG. 6.

If the support wheels 38 and 39 are now loaded by depositing a winding core 20 with a coil or wound package 36 thereupon in this upper end position of the shafts 42, then, due to the eccentric journalling of the shafts 42 in the journal members 43 and 44, a rotation of these journal members 43 and 44 in the direction of the arrow E (cf. FIG. 6) takes place. During this rotary motion the pivot levers 55 and 56 are entrained to overcome a force of the tension springs 58 and 59 and are pivoted through a dead-center position downward into the lower end position illustrated in FIG. 4. The pivoting motion of the pivot levers 55 and 56 is transmitted through the connecting rods 53 and 54 to the plunger 50 and therefore to the brake shoe 58 which is moved downward in the direction of the arrow D until the brake shoe 58 comes into contact with the traction surface 22 of the winding core 20 with its brake lining 49. The braking force which acts upon the traction surface 22 is therefore regulated by the weight of the winding core 22 and especially by the weight of the product coil or wound package 36 and is dependent upon the lever ratios of the actuating mechanism 52.

When lifting the winding core 20 from the support wheels 38 and 39, the brake shoe 48 is upwardly entrained in the direction of the arrow D with the result that the pivot levers 55 and 56 are pivoted upward into their upper end position while overcoming the force of the tension springs 58 and 59. The journal members 43 and 44 together with their shafts 42 are also entrained so that the support wheels 38 and 39 are also brought into their upper end position again. It is, of course, also possible to move the brake shoe 48 manually from its lower operative position into the upper idle position.

For unwinding the printed products from a product coil 36, a winding core 20 carrying such a product coil 36 is deposited upon the support wheels 38 and 39. The beginning of this deposition procedure is shown in FIG. 6. Under the weight of the product coil or wound package 36, the support wheels 38 and 39 are pivoted in the previously described manner in the direction of the arrow E, with the result that the brake shoe 48 is moved into its lower operative position in which its brake lining 49 is pressed against the traction surface 22 of the winding core 20. The printed products can now be unwound from the product coil or wound package 36 in known manner.

As explained in the previously mentioned German Pat. No. 3,122,888 and the corresponding U.S. Pat. No. 4,438,618 in detail, the winding core 20 together with the product coil or wound package 36 is set into rotation in the direction of the arrow F (cf. FIG. 4) by pulling on the winding strap 35 shown in dotted line in FIG. 4. A braking of the winding core 20 is thereby effected by the brake shoe 48 acting upon the winding core 20. Since, as already mentioned, the braking force acting upon the winding core 20 is dependent upon the weight borne by the support wheels 38 and 39, this braking force is greatest when the coil or wound package 36 is full and decreases as the coil or wound package 36 diminishes in size. In this manner the desirable effect is achieved that the braking effect diminishes in the course of the unwinding procedure without requiring a special means of regulation.

When the empty winding core 20 is lifted off after termination of the unwinding procedure, the brake shoe 48 is, as already mentioned, moved into its upper idle position and the support wheels 38 and 39 are also pivoted back into their upper end positions.

There are various possibilities for the construction of the winding core 20. The embodiment shown in FIG. 7 is of simple construction and correspondingly light and economical to fabricate. In certain cases, however, more rigid constructions are necessary. Such constructions are now shown in FIGS. 8 and 9.

In the winding core 20 shown in FIG. 8, the annular rim 21 is provided with a continuous rib or boss 61 which protrudes inwardly. A winding core 20 constructed in this manner is primarily suitable for use in winding and unwinding stations 1 and 37 of the type shown in FIGS. 1 through 6 in which the support wheels 2 and 3, respectively 38 and 39, comprise two rollers 4 and 5, respectively 40 and 41, which mutually form a gap in which the rib 61 engages. In this case, the rib 61 assists in guiding the winding core 20 upon the support wheels 2 and 3 or 38 and 39.

In the embodiment illustrated in FIG. 9, a stiffening effect is achieved in that the edges 23*a* and 24*a* of the protruding side flanges 23 and 24, respectively, are bent back which forms a sort of return flange. In this modified embodiment, the traction surface 22 of the winding core 20 remains flat over its entire width which permits, as in the winding core 20 according to FIG. 7, employing support wheels 2 and 3 or 38 and 39 comprising a single roller.

As shown in FIG. 2, the winding cores 20 are narrower than the product coils or wound packages 36. In certain cases, especially for very thin products, it can be necessary to form the support surface for the printed products upon the winding core 20 somewhat wider. This can, for instance as indicated in FIG. 10, be effected in that the outermost side of the annular rim 21 of the winding core 20 is provided with an annular support surface or annulus 62 which protrudes laterally beyond the annular rim 21. In this manner it can be achieved that the printed products in the product coil or wound package 36 can bear upon a greater surface area without having to make the annular rim 21 and therefore also the traction surface 22 wider.

The configuration of the drive for the winding core 20 as a friction wheel drive arrangement in the winding procedure brings many advantages. For instance, the winding core 20 can be configured as an annular friction wheel which can be quickly deposited upon the support wheels 2 and 3 for coupling to the winding station 1 and quickly lifted off the support wheels 2 and 3 for decoupling from the winding station 1 without difficulty. This is, of course, also true for coupling to the unwinding station 37 and decoupling from such unwinding station 37. The side flanges 23 and 24 laterally delimiting the traction surface 22 of the winding core 20 ensure an impeccable lateral guidance of the winding core 20 upon the wheels 2 and 3, respectively 38 and 39. Furthermore, these side flanges 23 and 24 facilitate the position of the winding core 20 upon the support wheels 2 and 3, respectively 38 and 39, since these side flanges 23 and 24 effect an automatic centering should the winding core 20 be deposited upon the support wheels 2 and 3 or 38 and 39 in a skew position.

Both the winding station 1 and the unwinding station 37 can be of relatively simple construction. No complicated coupling mechanism for effecting a driving connection between the drive means and the winding core 20 is required in the winding station 1. No special apparatus is required for actuating the brake in the unwinding station 37 or for regulating the braking force, since the weight of the product coil or wound package is exploited for actuating the brake.

The winding core 20 is also simple in construction and can therefore be fabricated in economical manner. This, as well as simple manipulation, is significant since a great number of such winding cores 20 are required in a printing plant. Procurement and storage of these winding cores should be as economical as possible. The fact that the empty winding cores 20 can be stored in a small space contributes to fulfilling this requirement. Little space is also required for the intermediate storage of the full winding cores 20, since the winding core 20, as already mentioned, is narrower than the product coil or wound package 36 or has at most the same width as the product coil or wound package 36, i.e. because the winding core 20 does not protrude laterally beyond the product coil or wound package 36.

While there are shown and described present preferred embodiments of the invention, it is to be distinctly understood that the invention is not limited thereto, but may be otherwise variously embodied and practiced within the scope of the following claims.

ACCORDINGLY,

What I claim is:

1. An apparatus for unwinding flexible, substantially flat products, especially printed products, wound together with a winding strap into a wound package from such a wound package, comprising:

a substantially hollow and substantially cylindrical winding core;

a support arrangement for rotatably and releasably supporting said core;

said core being constructed as an annular friction wheel;

said annular friction wheel being structured for deposition upon and lifting from said support arrangement;

said annular friction wheel having an inner side and a longitudinal axis;

said annular friction wheel containing at said inner side a traction surface coaxial with said longitudinal axis;

said annular friction wheel comprising side flanges extending inwardly towards said longitudinal axis for laterally delimiting said traction surface;

said support arrangement comprising freely rotatable support wheels;

said traction surface bearing upon said freely rotatable support wheels; and a braking member structured for operatively engaging said core.

2. The apparatus as defined in claim 1, wherein:

said core comprises an annular rim;

said annular rim comprising an exposed inner surface;

said exposed inner surface forming said traction surface; and said side flanges extending inwardly from said annular rim.

3. The apparatus as defined in claim 1, wherein:

said rotatable support wheels are two in number and are situated opposite one another in relation to and to opposite sides of a substantially vertical plane;

each rotatable support wheel of said rotatable support wheels having an axis of rotation; and each said axis of rotation extending in a direction substantially parallel to said substantially vertical plane.

4. The apparatus as defined in claim 1, further including:

an actuating mechanism; and said braking member being advanceably and retractably engageable with said traction surface by means of said actuating mechanism.

5. The apparatus as defined in claim 4, wherein:

said braking member is arranged beneath said freely rotatable support wheels.

6. The apparatus as defined in claim 4, wherein:

said braking member has an operative position and an idle position;

said braking member being structured for being brought into said operative position thereof when said core is deposited upon said freely rotatable support wheels; and said braking member being structured for being brought into said idle position thereof when said core is lifted off said freely rotatable support wheels.

7. The apparatus as defined in claim 6, wherein:

said freely rotatable support wheels have a loaded position and an unloaded position;

said freely rotatable support wheels being journalled for motion between said loaded position and said unloaded position; and said freely rotatable support wheels being coupled to said actuating mechanism such that said actuating mechanism advances said braking member into engagement with said traction surface when said rotatable support wheels are loaded.

8. The apparatus as defined in claim 7, further including:

rotatably journalled journal members;

each freely rotatable support wheel being eccentrically mounted on an associated one of said rotatably journalled journal members; and each said rotatably journalled journal member being connected to said actuating mechanism such that said braking member is moved into said operative position thereof when said journal members rotate under loading of said freely rotatable support wheels.

9. The apparatus as defined in claim 8, further including:

a pivot lever;

each said rotatably journalled journal member being connected to said pivot lever;

means for longitudinally translatably guiding said braking member; and said pivot lever serving for advancing and retracting said braking member.

10. A substantially hollow, substantially cylindrical winding core for employment in an apparatus for winding flexible, substantially flat products, especially printed products, arriving continuously, especially in imbricated formation, together with a winding strap into a wound package and for unwinding the same from such a wound package, wherein:

said winding core is constructed as an annular friction wheel of a friction wheel drive arrangement;

said annular friction wheel having an inner side and a longitudinal axis;

said annular friction wheel containing at said inner side a traction surface coaxial with said longitudinal axis; and said annular friction wheel comprising side flanges extending inwardly toward said longitudinal axis for laterally delimiting said traction surface and for preventing udesired lateral drift of the annular friction wheel in the direction of the longitudinal axis of the annular friction wheel during a winding operation.

11. The winding core as defined in claim 10, wherein:

said annular friction wheel comprises an annular rim;

said annular rim comprising an exposed inner surface defining said inner side and forming said traction surface;

said exposed inner surface forming said traction surface; and said side flanges extending inwardly from said annular rim.

12. The winding core as defined in claim 11, wherein:

said annular rim is provided with a continuous inwardly projecting annular rib.

13. The winding core as defined in claim 11, wherein:

said side flanges have edges; and said edges being return flanged.

14. The winding core as defined in claim 11, wherein:

said annular rim has an outer side; and a support annulus for the products extending laterally beyond said annular rim being provided upon said outer side.

15. The winding core is defined in claim 10, wherein:

said side flanges are integrally formed with said annular friction wheel.

16. The winding core is defined in claim 10, wherein:

said annular friction wheel comprises an annular rim having a outer side;

said outer side having oppositely situated ends; and said side flanges extending from said oppositely situated ends of said outer side of said annular friction wheel radially inwardly towards said longitudinal axis of said annular friction wheel.

* * * * *

UNITED STATES PATENT AND TRADEMARK OFFICE

CERTIFICATE OF CORRECTION

PATENT NO. : 4,682,741

DATED : July 28, 1987

INVENTOR(S) : WERNER HONEGGER

It is certified that error appears in the above-identified patent and that said Letters Patent is hereby corrected as shown below:

Column 4, line 12, please change "sprockets sprockets" to --sprockets--

Claim 1, line 6, please delete "winding"

Claim 15, line 1, please change "is" to --as--

Claim 16, line 1, please change "is" to --as--

Claim 16, line 3, please change "a" to --an--

Signed and Sealed this

Eighth Day of March, 1988

*Attest:*

DONALD J. QUIGG

*Attesting Officer*

*Commissioner of Patents and Trademarks*